US008258387B2

(12) United States Patent
Goodman

(10) Patent No.: US 8,258,387 B2
(45) Date of Patent: Sep. 4, 2012

(54) CLAMPING BALL END FOR MUSICAL STRINGS

(76) Inventor: Garry Goodman, Los Angeles, CA (US)

( * ) Notice: Subject to any disclaimer, the term of this patent is extended or adjusted under 35 U.S.C. 154(b) by 0 days.

(21) Appl. No.: 12/206,650

(22) Filed: Sep. 8, 2008

(65) Prior Publication Data

US 2010/0236373 A1 Sep. 23, 2010

(51) Int. Cl.
*G10D 3/10* (2006.01)

(52) U.S. Cl. ..... 84/297 R

(58) Field of Classification Search ..... 84/297 R
See application file for complete search history.

(56) References Cited

U.S. PATENT DOCUMENTS 4,170,161 A * 10/1979 Kaftan ..... 84/312 R
4,574,678 A * 3/1986 Edwards ..... 84/314 N
4,648,303 A * 3/1987 Braathen et al. ..... 84/306
4,686,883 A * 8/1987 Piche et al. ..... 84/313
5,277,095 A * 1/1994 Steinberger ..... 84/304
5,361,667 A * 11/1994 Pritchard ..... 84/297 R
5,932,822 A * 8/1999 Bernstein ..... 84/314 N
6,111,176 A * 8/2000 Rose ..... 84/297 S
6,172,287 B1 * 1/2001 Kang ..... 84/304
7,394,005 B1 * 7/2008 Anderson et al. ..... 84/297 R

* cited by examiner

*Primary Examiner* — David Warren
*Assistant Examiner* — Christopher Uhlir
(74) *Attorney, Agent, or Firm* — Robert J. Lauson; Lauson & Tarver LLP

(57) ABSTRACT

This invention relates to a ball-ender apparatus for securing to a pre-selected length wire by passing through the apparatus and being secured by a precision screw from which the wire receives medial pressure locking the wire in place. Without an expensive winding machine or winding of wire or even modifications made to musical instruments, wire can be tensioned, after the precision screw is screwed onto the wire within the clamping ball end housing to securely hold the wire in place.

8 Claims, 3 Drawing Sheets

CLAMPING BALL END FOR MUSICAL STRINGS

FIELD OF THE INVENTION

This invention relates to a ball-ender apparatus, and more particularly to such an apparatus for securing to a pre selected length wire by passing through the apparatus and being secured by a precision screw from which the wire receives medial pressure locking the wire in place.

BACKGROUND OF THE INVENTION

Wire musical instrument strings, as for electric bass guitars, guitars, etc., normally have one end terminated by a so-called ball end. Such a ball end normally is hollow, has a coaxial through-hole and has a substantially cylindrical outer peripheral surface with an annular groove intermediate its ends which snugly receives a loop of the wire closed by twisting of the wire immediately adjacent such loop and ball end. Such ball end thus forms an enlargement at the end of the wire string by which the latter can be fixed to a member on the body of the musical instrument and from which the wire extends to connect at its unballed end to a tuning key or the like at the head of the instrument.

In a prior machine for securing one end of a wire musical instrument string to a ball end with a twist, the wire is fed behind the ball end tangential to the groove therein, the ball end is moved rearwardly from the wire path to form a U-shape around the ball end, the trailing end of the wire is severed to form the short leg of the U-shape, the legs are clamped and the ball end is rotated to form such twist (hereinafter referred to as a single twist), whereafter the interconnected ball end and wire are ejected from the machine.

While such prior machine has for the most part been satisfactory in terms of formation of such a single twist, the present invention is the result of a continuing effort to achieve improved performance and reliability of operation of producing a ball-ended musical instrument string of desired length wherein the finished product may be provided without the use of expensive and cumbersome equipment.

Currently many types of music strings require a "ball end" to attach and secure the non-stretching part of the musical string to the musical instruments tail piece or bridge.

The ball ending process currently in use requires the wire to be looped around the slotted brass "ball-end" and then twisted around itself a number of times in order to tie the string wire around the brass ball end. This process requires an expensive ball ender machine to do this.

There is a limit to the diameter of wire that can be used to make a string using this ball ending process; usually a 0.008 is the smallest size for plain steel strings. When the string breaks, the ball end is discarded because it cannot be attached to another wire without the expensive ballending machine.

The other option currently used is a special bridge that must be attached to the instrument. A company called Floyed Rose has created a clamping bridge that allows a string wire to be clamped at the securing end of the string. This special bridge requires the removal of the original bridge. Once attached to the instrument, only plain wire may be used without a ball end attached.

SUMMARY OF THE INVENTION

The current device (clamping ball end) looks similar to the traditional ball end in shape and size. It is very different in that it has an entrance and exit hole for the wire. In the center of the clamping ball end housing is a threaded hole. The string enters the entrance hole and is pulled to the exit hole. Then, a special screw inserted into the threaded hole clamps the wire down. The LBF (pounds of force measured with a digital torque screwdriver) for the particular wire is set and the clamping screw is screwed in to just the right amount of force so that the string wire stays in place while under tension from tuning to high notes. This is done without an expensive winding machine. There is no winding of wire. No modifications need to be made to musical instruments.

The ball-end is its own clamp. This process enables the string to be used on any instrument that uses the traditional "twist the wire around the ball end" type string. Unlike the "twist type" ball end, the string can be easily replaced by removing the clamp screw and inserting a new piece of wire. The clamp screw is then re-attached, thus making a new string.

The clamp ball ends are made in a variety of sizes to work with all string wire gauges.

These clamping ball ends allow small gauges of wire such as 0.007, 0.006, 0.005, 0.004 and 0.003 to be used. These small gauges of wire break easily during the looping and twisting process using traditional ball ends and ball ending methods. The clamping ball end does not twist the wire and thus eliminates extra tension on the string.

A digital torque driver can be used to screw the clamp screw in and tighten it to a precise LBF (pounds of force) to clamp each type of wire with exactly the perfect amount of force to secure the string without breaking it. In addition, the larger clamping ball end sizes also allow a larger diameter hex core wire (used in making round wound strings) to be used because the wire does not have to bend around the ball end, thus making a bass string with a larger hex core wire possible. This vastly improves the quality of bass strings over 0.160 of an inch as the core wire is not too thin, and therefore does not flop.

Traditional twist ball ends are limited to a hex wire no larger than about 0.034 but the clamp ball end can be made to accept hex wire as large as 0.100, thus making a new type of bass string possible.

The clamp ends can also be made out of steel for securing heavier gauge, higher tensile wire that would otherwise break when twisted around the traditional slotted twist ball end.

The number of threads in the clamp screw can change and the number of threads in the threaded hole in the housing can also change. The housing can also vary in size, shape etc. There is twist wire on slotted brass ball end, a clamping bridge which must be attached to the guitar, and then this concept, a string secured by a brass or steel, etc. clamp ball end.

DESCRIPTION OF THE PREFERRED EMBODIMENT

The clamping hex screw

The clamping ball end consists of two pieces.

The first piece is a precision threaded screw that can be a number of thread sizes. The size used for this description is a 4-80.

Looking at FIGS. 1-7, the present ball end (1) is used for both a guitar ball end and a bass guitar ball end. The ball end (1) size can vary depending on the instrument and type of string housing needed. For standard electric and steel string acoustic guitars and other similar instruments requiring a ball end to fit into a standardized bridge and tail piece, and for electric bass guitars, which require larger size housings, a standard set screw is used. Although the measurements can vary, the central outer diameter threaded section measurement is 0.110.

Figure 1:
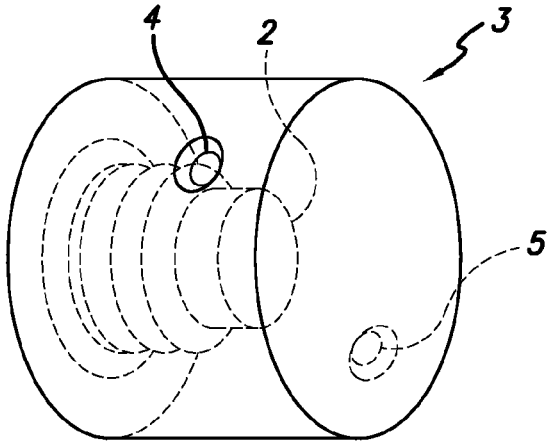
FIG. 1 is a bottom perspective view of the present ball end with the interior threaded cavity or threaded hole shown in phantom.
Figure 2:
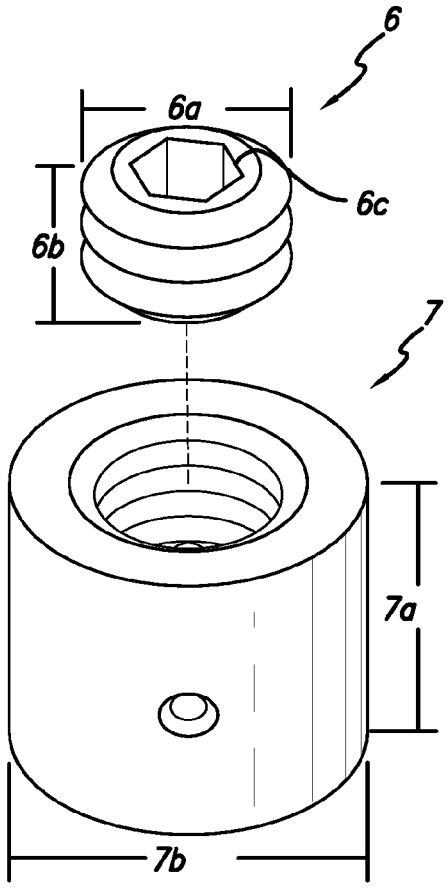
FIG. 2 is an exploded top perspective view, showing the screw member or set screw aligned with the interior threaded cavity.
Figure 3:
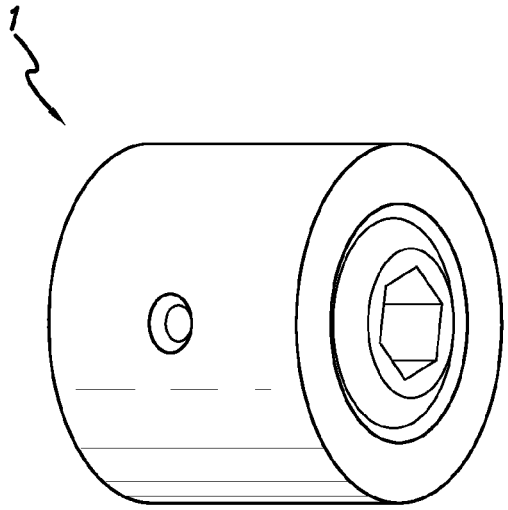
FIG. 3 is a top perspective view of the present ball end, showing the screw member threadably engaged within the threaded cavity.
Figure 4:
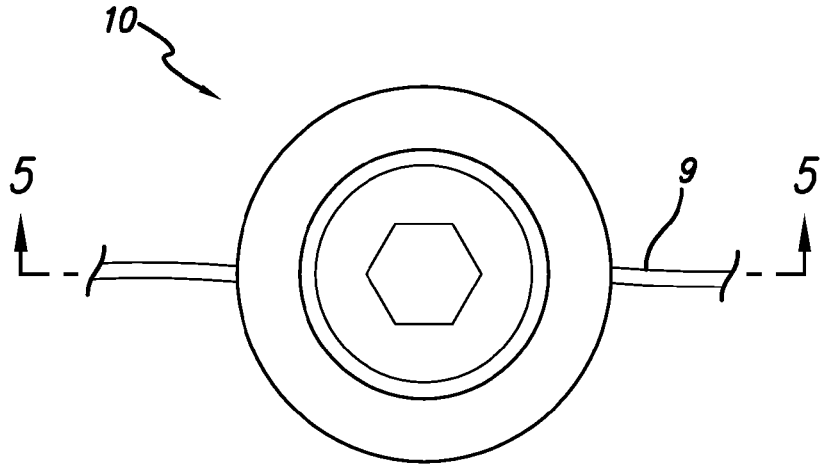
FIG. 4 is a top plan view of the present ball end, showing the screw member threadably engaged within the threaded cavity and a musical string threaded through the ball end body.
Figure 5:
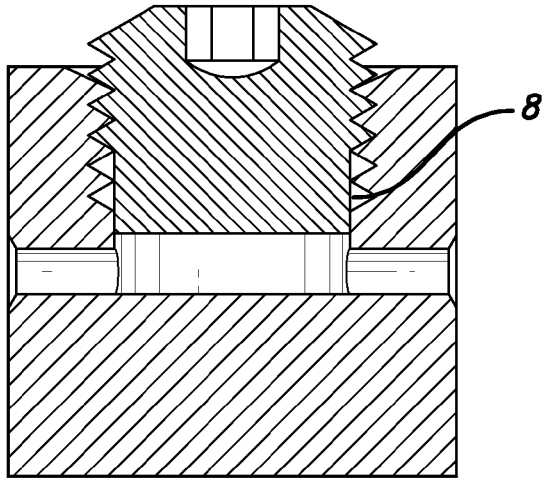
FIG. 5 is a side cross-sectional view of the present ball end, showing the screw member threadably engaged within the threaded cavity.
Figure 6:
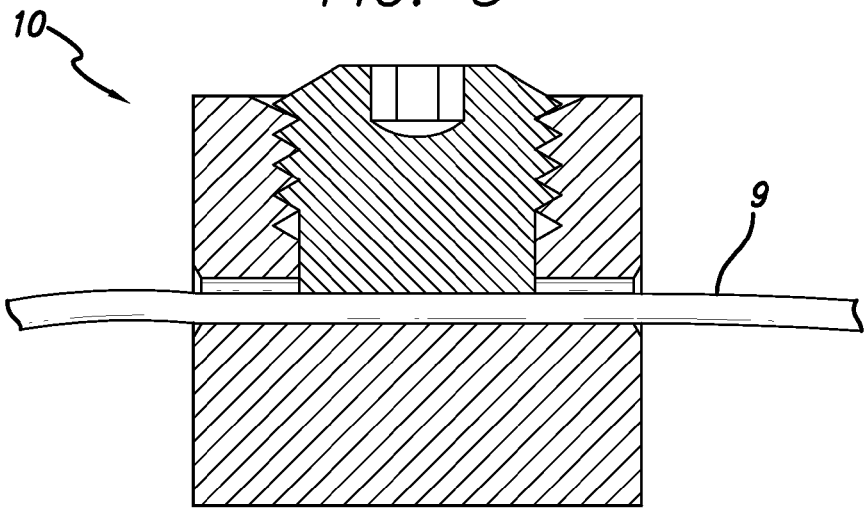
FIG. 6 is a side cross-sectional view of the present ball end, showing the musical string threaded through the ball end body from a first or entrance hole, through the threaded cavity and out a second or exit hole, with the musical string securely clamped against the flat bottom of the threaded cavity by the screw member.
Figure 7:
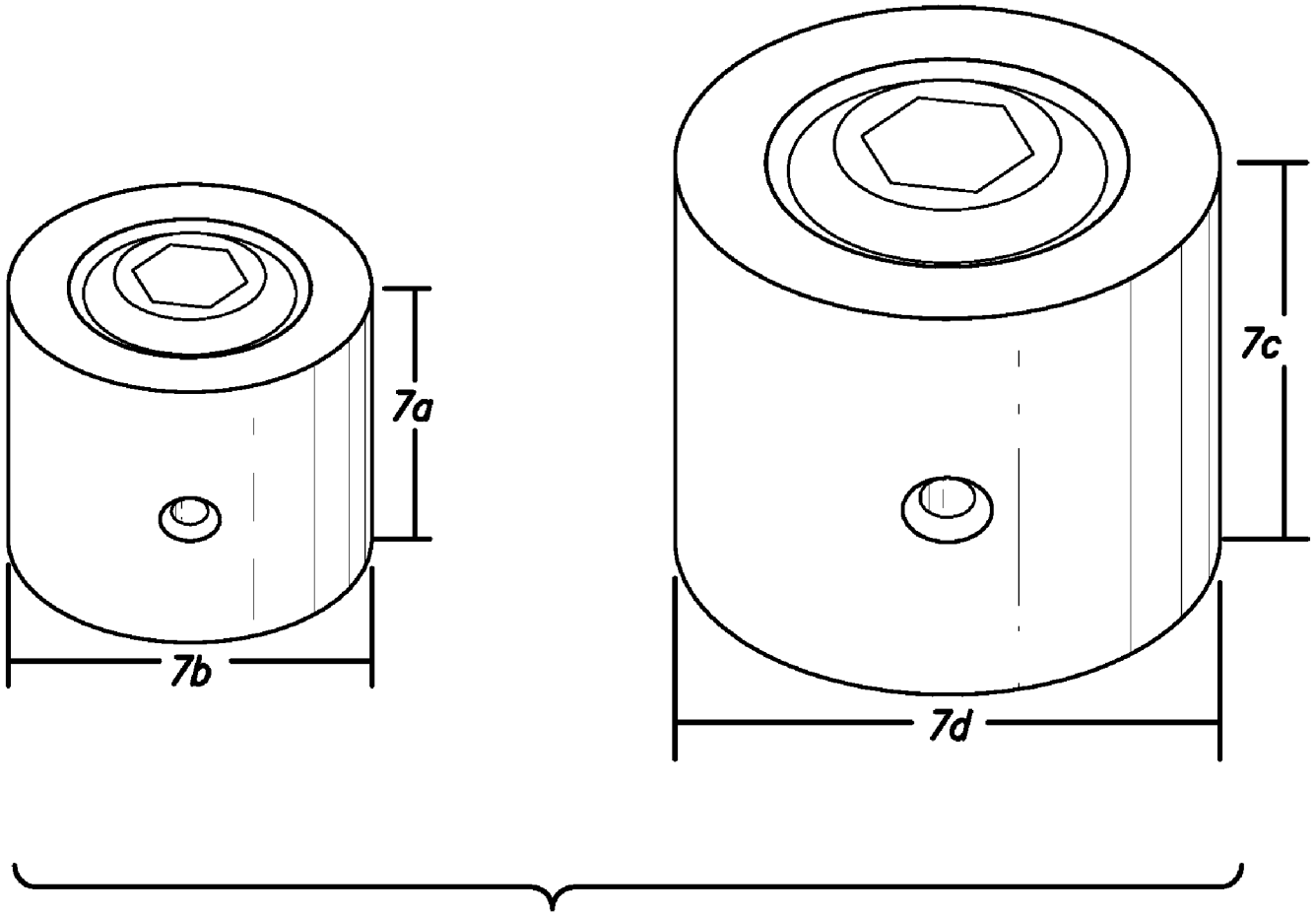
FIG. 7 is a top perspective view of the present ball end, showing two of the numerous size options available for accommodating various string diameters.

At the bottom of the threaded section is a flat bottom section (2) and the bottom of the screw (6) is flat. The smooth, flat section presses against the string wire (9) and secures the wire to the flat bottom (2) of the inside area of the housing (7). FIGS. 5-6 show that the flat bottom section (2) is substantially tangent or flush to the entrance hole (4) and exit hole (5) such that the musical string (9) will remain substantially straight as the screw (6) clamps down on the musical string (9).

The length of the screw is 0.076. A hex wrench is used to tighten the screw at the hex head section (6*c*). The amount of torque or LBF-in. used to tighten the screw (6) is measured to the desired amount. Set screws may also use a slot head, or any other type of screw heads (Phillips head, etc.), instead of a hex head screw.

The second piece of the clamping ball end is the clamping ball end housing (7). The clamping ball end housing is a cylinder shaped piece of metal made from brass, steel, or any other suitable materials capable of clamping and holding in place the end of a musical instrument string under tension. For standard guitars, this housing has a length that is 0.125 (7*a*), an outer diameter that is 0.150 (7*b*) and a threaded inner diameter that is 0.098. (8) This guitar string clamping ball end (7) has a string wire entrance hole (4) and exit hole (5) that is 0.017.

The Bass guitar clamping ball end (7*c*, 7*d*) housing has a length that is 0.185 (7*c*) and outer diameter that is 0.250 (7*d*) and a threaded inner diameter (8) that is 0.098. The clamping ball end (7*c*, 7*d*) has and entrance hole (4) and an exit hole (5) that is 0.034.

These housings (7) and the set screws (6), entrance holes (4) and exit holes (5) and threaded holes (8) can vary in measurements depending on the need to accommodate a particular stringed instrument such as an electric violin, pedal steel guitar or even a lute.

The string wire (9) is fed into the entrance hole (4) until it protrudes from the exit hole (5). A hex screw driver drives the hex set screw (6) by inserting the screwdriver blade into the hex head slot (6*c*) and the threaded area of the set screw (6*b*) turns into the threaded hole (8) on the clamping ball end housing (7) until the string wire (9) is secured by the desired pre-determined amount of force in LBF-in. needed for a particular gauge music string wire (9) to hold it in place securely. The finished string (10) is then ready to be put on the musical instrument.

Should the string break, the hex set screw (A) can be unscrewed and a broken string wire removed and then a replacement wire can be attached.

What is claimed is:

1. A ball end for attachment to an end of a musical string such that the musical string can be anchored to a stringed instrument having a standard bridge, the ball end comprising:

a ball end body with an outer surface;

a threaded hole formed partially through the ball end body and terminating with a substantially flat bottom;

a string entrance hole transverse to the threaded hole and extending between the outer surface of the ball end body and the threaded hole;

a screw with a substantially flat tip configured to threadably engage the threaded hole;

wherein the string entrance hole is configured for receiving the musical string and permitting the musical string to lie transversely within the threaded hole;

and wherein the screw is configured to be torqued to engage the musical string in clamping engagement;

and wherein the ball end is configured to engage the standard bridge.

2. The ball end of claim 1 wherein a string exit hole is formed in opposing alignment with the string entrance hole such that the musical string may be threaded through the ball end without substantial bending of the musical string, the string exit hole extending between the outer surface of the ball end body and the threaded hole.

3. The ball end of claim 1 wherein a portion of the string entrance hole is substantially flush with the substantially flat bottom such that the musical string remains substantially unbent while in clamping engagement with the substantially flat tip of the screw.

4. The ball end of claim 1 wherein a string exit hole is formed in opposing alignment with the string entrance hole and a second portion of the string exit hole is substantially flush with the substantially flat bottom such that when the musical string is threaded completely through the ball end body, the musical string remains substantially unbent while under clamping engagement with the substantially flat tip of the screw.

5. The ball end of claim 1 wherein the ball end body is cylindrical.

6. The ball end of claim 5 wherein the threaded hole is formed on a plane of the cylinder, a threaded hole axis arranged perpendicular to the plane and the substantially flat bottom arranged parallel to the plane.

7. The ball end of claim 6 wherein a string entrance hole axis is parallel to the plane.

8. A method of attaching a ball end to a musical string, comprising the steps of:

providing a ball end body having a threaded hole formed partially therethrough and with a substantially flat bottom, a string entrance hole transverse to the threaded hole, and a screw with a substantially flat tip;

determining a specified torque based on the musical string properties and desired musical properties;

threading the musical string into the string entrance hole so that at least a portion of the musical string lies within the threaded hole;

threading the screw into the threaded hole so that the substantially flat tip of the screw compressively engages the musical string;

applying the specified torque to the screw to clamp the musical string between the substantially flat tip the screw and the substantially flat bottom of the threaded hole; and anchoring the musical string to a standard bridge of a stringed instrument without substantial modification of the standard bridge.

* * * * *